US006421019B1

(12) United States Patent
Albertelli et al.

(10) Patent No.: US 6,421,019 B1
(45) Date of Patent: Jul. 16, 2002

(54) AUTOMATIC VEHICLE MOUNTED ANTENNA DEPLOYMENT SYSTEM

(76) Inventors: Ronald J. Albertelli; John S. Albertelli, both of 134 Berry Farm Rd., Johnston, SC (US) 29832

( * ) Notice: Subject to any disclaimer, the term of this patent is extended or adjusted under 35 U.S.C. 154(b) by 0 days.

(21) Appl. No.: 09/933,391

(22) Filed: Aug. 20, 2001

(51) Int. Cl.[7] ..... H01Q 1/32
(52) U.S. Cl. ..... 343/713; 343/880
(58) Field of Search ..... 343/711, 713, 343/878, 880, 881

(56) References Cited

U.S. PATENT DOCUMENTS 4,663,633 A * 5/1987 Wilson ..... 343/714
5,554,998 A * 9/1996 Sherwood et al. ..... 343/881
5,961,092 A * 10/1999 Coffield ..... 343/713
6,175,339 B1 * 1/2001 Macon ..... 343/892

* cited by examiner

*Primary Examiner*—Don Wong
*Assistant Examiner*—Hoang Nguyen
(74) *Attorney, Agent, or Firm*—Goldstein & Lavas, P.C.

(57) ABSTRACT

An antenna deployment system, for use in mounting an antenna assembly to a vehicle having a vertical surface. The deployment system is housed within a cabinet having sides, a rear, a bottom, an open top, an open front, and cabinet doors which selectively close the cabinet front. A platform is hingeably mounted to the cabinet rear and is capable of entering a deployed horizontal position wherein the platform extends across the open top for allowing the antenna assembly itself to enter an operative position, and a stowed vertical position wherein the antenna assembly is parked against the platform and wherein the antenna assembly is retracted safely within the cabinet and is closed therein by the cabinet doors.

7 Claims, 5 Drawing Sheets

AUTOMATIC VEHICLE MOUNTED ANTENNA DEPLOYMENT SYSTEM

BACKGROUND OF THE INVENTION

The invention relates to an automatic deploying vehicle mounted antenna. More particularly, the invention relates to a system which allows an antenna system to be used in conjunction with a vehicle, wherein the antenna is stored in a protective manner while the vehicle is in motion, and is automatically deployed when the vehicle is stationary.

The most common vehicle used for interstate trucking is the tractor/trailer combination. Such trucks include a tractor portion, which houses the engine and the driver. Many of these modern tractors have a cab with living quarters behind and above the driver's seat. These living quarters often have many of the conveniences found in larger mobile homes.

One important "modern" convenience to most drivers is television. When in a layover in a strange place, there is often little else to do but watch television. Unfortunately, in many of these places standard VHF and even UHF signals are weak or non-existent. The trucker is often relegated to watching a single channel, dominated by static and snow.

Satellite television can theoretically open a world of choices for the trucker. Some satellite television systems can even provide high-speed internet access for an otherwise isolated trucker. U.S. Pat. No. 4,931,809 to Putman et al. discloses a mounting bracket for mounting a satellite antenna on top of the cab of a tractor/trailer. However, satellite television antennas can be both fragile and expensive. Accordingly, a visible satellite antenna, mounted on the roof of the truck, both invites theft and damage while on the road.

U.S. Pat. No. 5,515,065 to Sherwood et al. discloses a deployable satellite antenna for use with vehicles. The antenna has a deployed position where it is oriented toward the sky, and a parked position, wherein it is folded so that the dish is oriented downward. Unfortunately, even when in the parked position, Sherwood is still left "out in the open", where it is vulnerable to the elements, road hazards, vandalism and theft.

While these units may be suitable for the particular purpose employed, or for general use, they would not be as suitable for the purposes of the present invention as disclosed hereafter.

SUMMARY OF THE INVENTION

It is an object of the invention to provide a vehicle mounted antenna system which allows a satellite antenna to be deployed such that it has an unobstructed line-of-sight with the sky, yet can be stowed such that it is fully hidden from view and protected from damage. Accordingly, the antenna system employs a unique cabinet design wherein the antenna assembly pivots upward to a horizontal position for use, and downward to a vertical position for storage behind closing doors.

It is another object of the invention to provide a vehicle mounted antenna system which automatically deploys when the vehicle is parked, and stows when the antenna assembly enters its storage position. Accordingly, the vehicle mounted antenna system has controls which are provided in the cab and which allow the antenna to be deployed. In addition, the antenna system detects when the antenna assembly enters its storage (parked) position, and initiates the process of stowing the antenna assembly within the cabinet. Further, detection and alarm systems are provided to warn the driver that the antenna is deployed if the driver attempts to move the vehicle.

It is a still further object of the invention to provide a system which accomplishes deployment and stowage in a fully automatic fashion. Accordingly, the system is configured so that the platform pushes the doors open as it pivots upward to the horizontal position, and pulls the doors closed when it pivots downward to the vertical position.

The invention is a antenna deployment system, for use in mounting an antenna assembly to a vehicle having a vertical surface. The deployment system is housed within a cabinet having sides, a rear, a bottom, an open top, an open front, and cabinet doors which selectively close the cabinet front. A platform is hingeably mounted to the cabinet rear and is capable of entering a deployed horizontal position wherein the platform extends across the open top for allowing the antenna assembly itself to enter an operative position, and a stowed vertical position wherein the antenna assembly is parked against the platform and wherein the antenna assembly is retracted safely within the cabinet and is closed therein by the cabinet doors.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
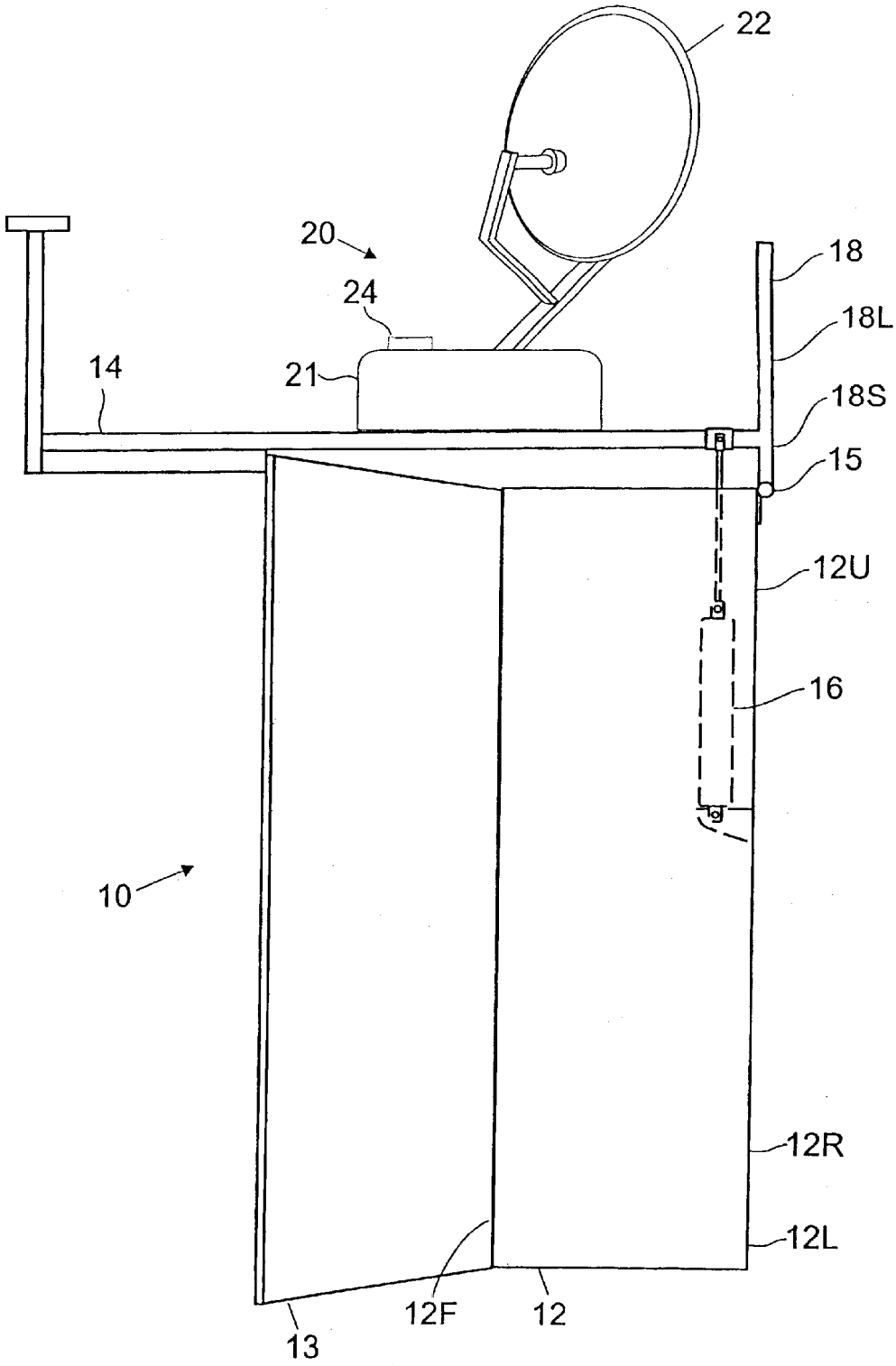
FIG. 1 is a side elevational view, illustrating the antenna deployment system fully deployed, with the antenna assembly in its operative position.
Figure 3:
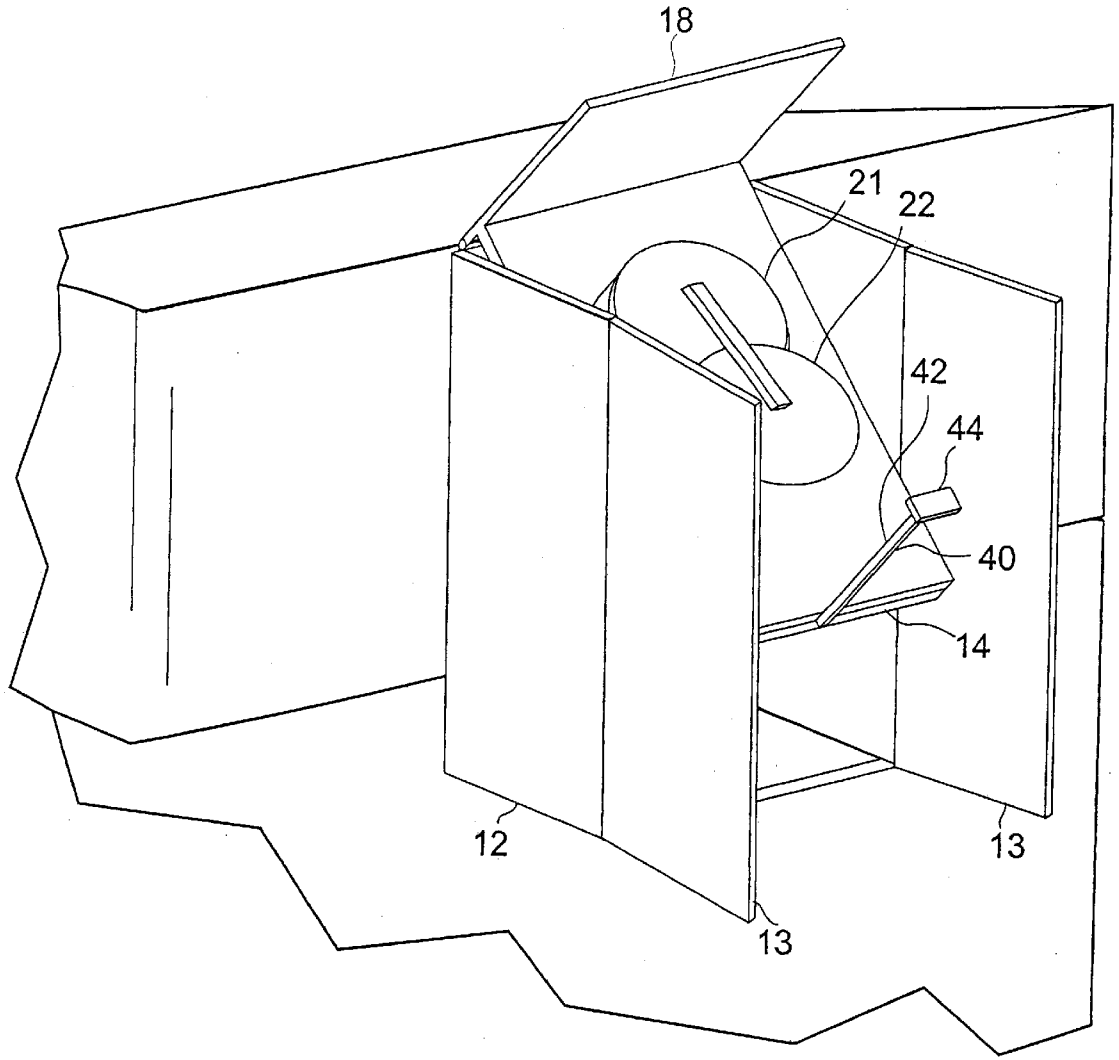
FIG. 3 is a diagrammatic perspective view, illustrating the antenna assembly in its parked position, wherein the deployment system is in the process of entering its stowed position.

FIG. 1 illustrates an antenna deployment system 10 having a cabinet 12 and a platform 14. The cabinet 12 has a cabinet upper end 12U, a cabinet lower end 12L, a cabinet front 12F and a cabinet rear 12R. Cabinet doors 13 are hingeably attached to the cabinet 12 at the cabinet front 12F. An antenna assembly 20 is mounted on top of the platform 14. The antenna assembly 20 includes an antenna assembly housing 21 which is mounted to the platform, and a dish 22 which is capable of entering an operative position, as illustrated in FIG. 1, wherein the dish 22 is oriented upward. The antenna assembly 20 is also capable of entering a parked position, wherein the dish 22 is folded downward against the antenna assembly housing 21, as seen in FIG. 3. U.S. Pat. No. 5,515,065 to Sherwood et al. describes an antenna assembly which has similar general operating constraints as the antenna assembly 20 employed in conjunction with the present invention. That is, it extends upward from its housing for operation, and mechanically folds downward against the housing to enter a safe position for withstanding the jolts of over-road travel.

An end plate 18 is fixed to the platform 14 and extends perpendicular thereto. The end plate 18 is fixed to the platform 14 such that the platform 14 divides the endplate 18 into a short segment 18S and a long segment 18L. The short segment 18L is hingeably coupled to the cabinet 12 at the cabinet upper end 12U with a main hinge 15.

As illustrated in FIG. 1, the platform 14 is in its extended position, wherein the platform 14 extends horizontally. The platform 14 enters this position through an actuation mechanism 16, which is simplistically shown in FIG. 1. The actuation mechanism 16 may be any mechanism, whether electrical, hydraulic, pneumatic, or otherwise, which is capable of raising the platform 14 to the extended position shown in FIG. 1, and gently lowering the platform by allowing the platform to pivot about the main hinge 15 as in FIG. 3, until it fully retracts within the cabinet 12. Accordingly, the actual raising and lowering of the platform 14 may be accomplished through pistons, stepper motors, etc. the selection and configuration of which is well within knowledge of one of ordinary skill in the art, and need not be discussed in detail herein. In addition, support brackets may be provided to support the platform and which work in conjunction with the actuation mechanism, as would be similarly appreciated and understood by one of ordinary skill in the art.

Figure 2:
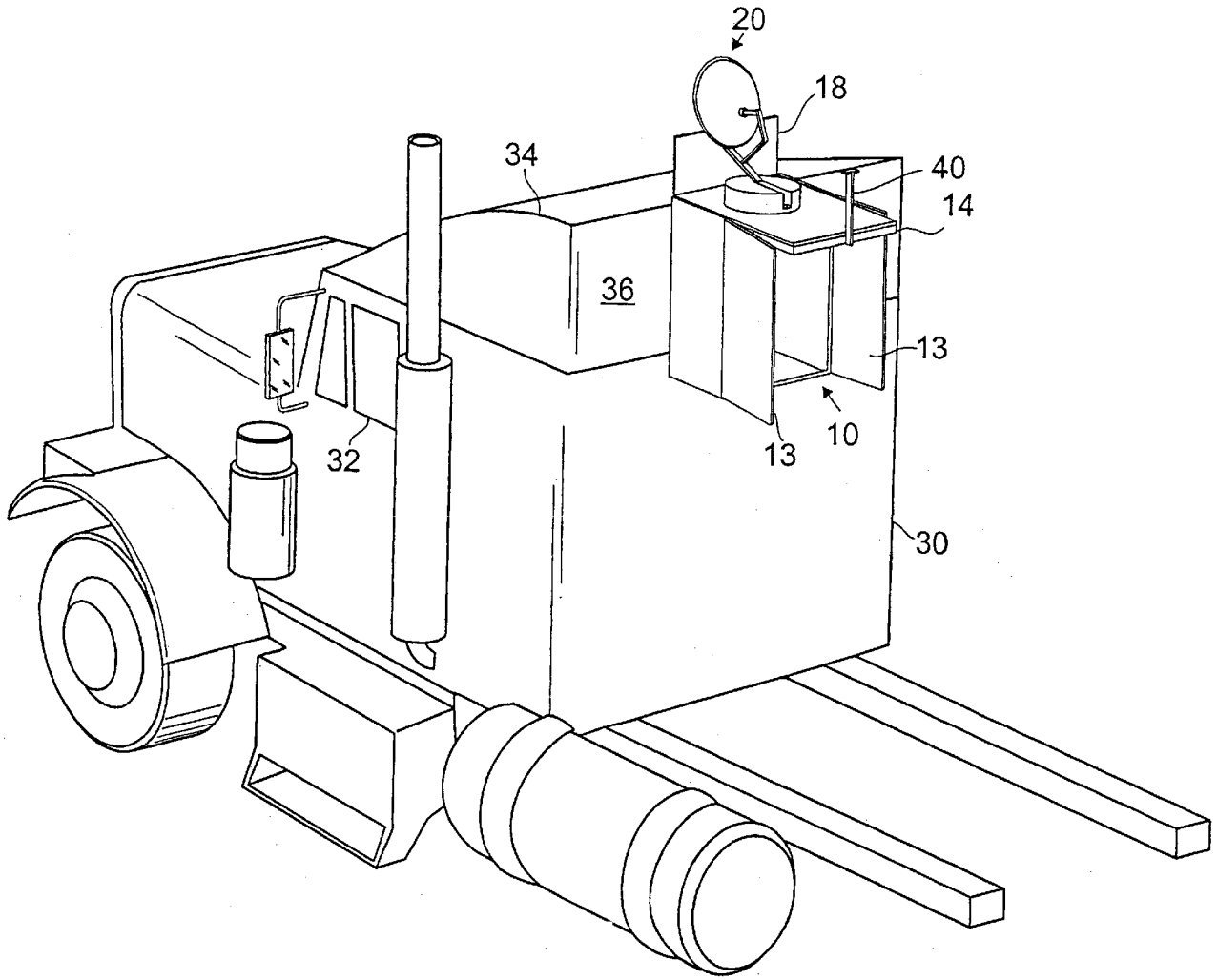
FIG. 2 is a diagrammatic perspective view, illustrating the fully deployed antenna deployment system mounted to the rear of a tractor cab.

FIG. 2 illustrates the deployment system 10 mounted to a truck cab 30. The truck cab 30 has a driver area 32, from which the truck is driven, and living quarters 34, which are behind and above the driver area 32. The truck cab 30 has a rear surface 36 adjacent to the living quarters 34. The cabinet is mounted to the rear surface 36.

As seen in FIG. 2, the cabinet doors 13 are open, and are in fact held open by the platform 14. The cabinet 12 has sides, a rear, and a bottom, but has no top. the platform 14 forms the top of the cabinet 12 when the platform is horizontal, and the end plate 18 forms the top of the cabinet 12 when the platform is vertical. The cabinet 12 defines an interior space within which the platform 14, as well as the antenna assembly 20 mounted thereto, are stored.

In the position of FIG. 1 and FIG. 2, the antenna assembly 20 is fully operative, wherein the dish is oriented toward the sky. However, when it is desirable to move the truck 30, the dish must be parked, and the platform stowed. Accordingly, referring momentarily to FIG. 1, a limit switch 24 is mounted proximal to the antenna assembly 20, which detects when the dish 22 is folded against the antenna assembly housing 21. Thus, before stowing the platform, the dish 22 must be parked. Parking the dish 22 is initiated using antenna assembly controls 28, indicated in block diagram FIG. 5. However, once the dish 22 is parked, it activates the limit switch 24, which initiates the lowering of the platform 14 to the vertical position. Accordingly, the actuation mechanism 16 is activated, causing the platform to lower toward vertical, as shown in FIG. 3. The actual placement of the limit switch 24 may be varied according to the particular design of the antenna assembly 20 used in conjunction with the deployment system 10 of the present invention.

Figure 4:
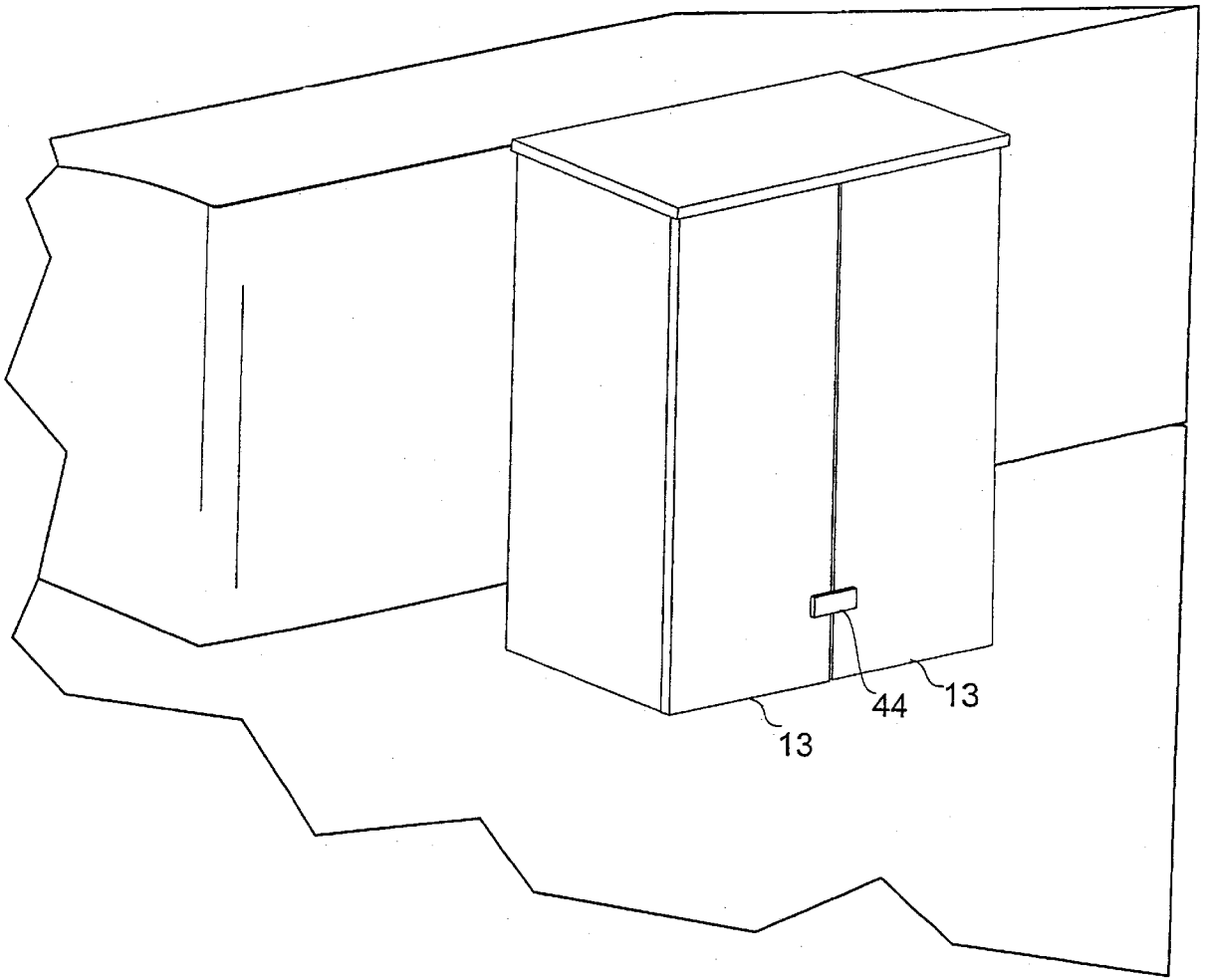
FIG. 4 is a diagrammatic perspective view, illustrating the antenna assembly fully stowed and hidden within the cabinet.

As seen in FIG. 1, 2, and 3, a door closer 40 extends perpendicularly from the platform 14, parallel to the end plate 18, and fully opposite on the platform 14 from the end plate 18. The door closer 40 comprises an elongated member 42 and a cross bar 44. When the platform 14 is lowered, the spring loaded cabinet doors 13 are allowed to close. Referring to FIG. 4, as they do so, the elongated member 42 extends directly between the cabinet doors 13, and as the platform 14 enters its vertical resting point, the doors 13 are pulled closed by the cross bar 44, which effectively locks the doors 13.

Figure 5:
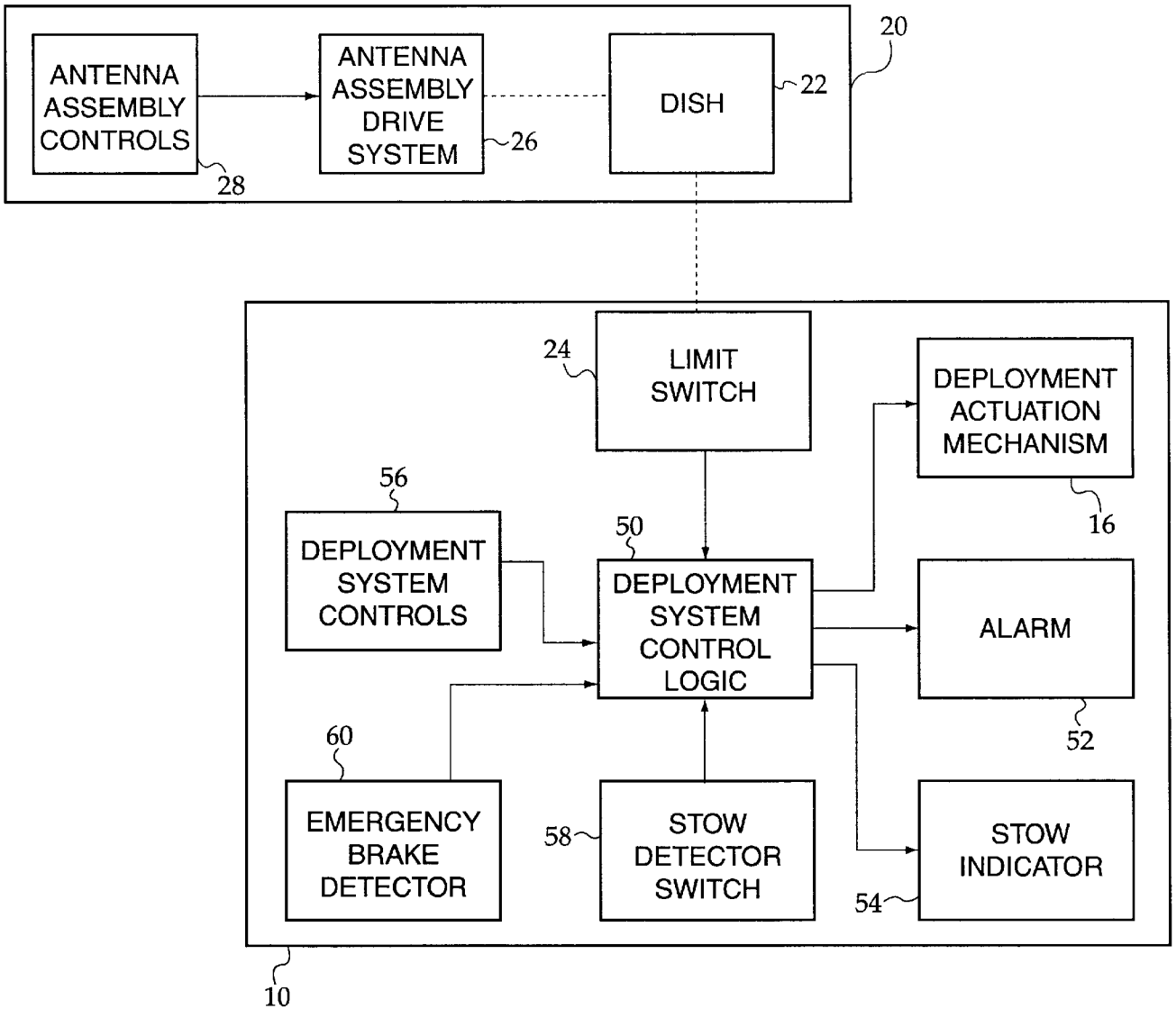
FIG. 5 is a functional block diagram of the antenna deployment system.

FIG. 5 illustrates interconnection of various functional components of the deployment system 10 which is the subject matter of the present invention, and the antenna assembly 20 which is used in conjunction therewith.

The antenna system 20, controls movement and positioning of the dish 22 using an antenna assembly drive system 26. The antenna assembly drive system 26 controls both positioning of the dish 22 for optimum signal reception, and for manipulating the dish 22 between its parked and operative positions. The antenna assembly controls 28 allows a user to initiate the parking of the dish, entering the dish into its operative position, positioning the dish in a desired direction in the sky, and other functions which are beyond the scope of the present discussion but which would pertain to the particular antenna system 20 used in conjunction with the deployment system 10 of the present invention.

The deployment system 10 has a deployment system control logic unit 50 which provides the overall functionality of the deployment system 10. As such, the deployment system control logic unit 50 is preferably microprocessor or microcontroller based. The deployment system control logic unit 50 controls the deployment actuation mechanism 16, and produces outputs to the user in the form of an alarm 52 and a stow indicator 54. Deployment system controls 56 include means for the user to signal the deployment system control logic unit 50 to deploy the antenna system once the vehicle is stationary. Further, the limit switch 24 is in communication with the logic unit 50, such that when parking of the dish 22 is detected by the limit switch 24, stowing of the antenna assembly is initiated. Once the stowing is completed, and the cabinet doors have closed and locked, a stow detector switch 58 in communication therewith signals the logic unit 50 of such status. In turn, the stow indicator 54 informs the user that it is safe to move the vehicle. Alternatively, an emergency brake detector 60, in communication with the vehicle emergency brake system, detects when the emergency brake has been released, and the logic unit 50 will sound the alarm 52 if the stow detector switch 58 is not currently indicating that the cabinet doors have been closed and locked. Accordingly, if the driver attempts to move the vehicle while the antenna assembly is deployed, the driver will be notified by the alarm 52 to first park the dish 22 and thereby stow the deployment system 10.

In conclusion, herein is presented a system for mounting a dish-based antenna assembly wherein the antenna assembly ineffectively and easily deployed when the vehicle is stationary, and stowed when the vehicle is in motion. In accordance with these principles, the invention has been described and illustrated by example in the foregoing text and in the accompanying description. However such examples are illustrative only of the inventive concept. Numerous variations are possible, while adhering to the inventive principles. Such variations are contemplated as being a part of the present invention.

What is claimed is:

1. An antenna deployment system, for allowing an antenna assembly to be mounted to a vehicle having a vertical surface, comprising:

a cabinet, the cabinet having sides, and open top and an open front, the cabinet having cabinet doors which selectively close across the cabinet front, the cabinet rear mountable against the vertical surface of the vehicle;

a platform, for mounting the antenna assembly, the platform hingeably connected the cabinet rear so that the platform is capable of entering a deployed position, wherein the platform extends horizontally across the cabinet open top, and a stowed position wherein the platform extends vertically within the cabinet so that the cabinet doors close and conceal the platform.

2. The antenna deployment system as recited in claim 1, further comprising an actuation system, for selectively causing the platform to enter the deployed horizontal position and the stowed vertical position.

3. The antenna deployment system as recited in claim 2, further comprising an end plate attached to and extending perpendicularly from the platform, the end plate hingeably connects the platform to the cabinet rear, the end plate extending across and closing the open top of the cabinet when the platform is in the vertical stowed position.

4. The antenna deployment system as recited in claim 3, wherein the antenna assembly comprises a dish and an antenna assembly housing, the antenna assembly housing containing an antenna assembly drive system which is capable of moving the dish between an operative position wherein the dish is oriented upwards and a parked position wherein the dish is oriented toward the platform, wherein the deployment system further comprises a limit switch which detects when the dish is in the parked position, and wherein the deployment system lowers the platform into the stowed position when the limit switch detects that the dish is in the parked position.

5. The antenna deployment system as recited in claim 4, further comprising a door closer, extending perpendicularly from the platform, fully opposite from the end plate, for pulling the cabinet doors closed and locking the cabinet doors as the platform enters its vertical stowed position.

6. The antenna deployment system as recited in claim 5, further comprising an emergency brake detector for detecting when the emergency brake has been released, a stow detector for detecting when the antenna assembly has been fully stowed, and an alarm, wherein the alarm sounds if the emergency brake has been released while the stow detector indicates that the antenna assembly has not been fully stowed.

7. The antenna deployment system as recited in claim 6, wherein the end plate is divided into an end plate short segment and an end plate long segment by the platform, the end plate short segment is hingeably attached to the cabinet rear, and wherein the actuation mechanism is located at the cabinet rear.

* * * * *